United States Patent [19]

Miyazaki et al.

[11] 4,341,177

[45] Jul. 27, 1982

[54] SMALL WATERCRAFT

[75] Inventors: Takeshi Miyazaki, Miki; Hiromi Ono, Akashi, both of Japan

[73] Assignee: Kawasaki Jukogyo Kaikan Kaisha, Kobe, Japan

[21] Appl. No.: 132,554

[22] Filed: Mar. 21, 1980

[30] Foreign Application Priority Data

Mar. 29, 1979 [JP] Japan ..... 54-41915[U]

[51] Int. Cl.[3] ..... B63B 43/06

[52] U.S. Cl. ..... 114/125; 114/288

[58] Field of Search ..... 114/125, 121, 288–290, 114/63

[56] References Cited

U.S. PATENT DOCUMENTS

| | | | |
|---|---|---|---|
| 1,444,150 | 2/1923 | Gadomski | 114/125 |
| 2,488,183 | 11/1949 | Garmont | 114/289 X |
| 2,729,183 | 1/1956 | Owen | 114/63 X |
| 3,503,358 | 3/1970 | Moesly | 114/125 |
| 3,736,608 | 6/1973 | Whitehead | 114/125 X |
| 3,842,784 | 10/1974 | Nelson | 114/125 |
| 4,048,939 | 9/1977 | Jones, Jr. | 114/125 |

*Primary Examiner*—Kathleen J. Prunner
*Attorney, Agent, or Firm*—Jordan and Hamburg

[57] ABSTRACT

A small watercraft including a hull of longitudinally elongated shape having a deck in its upper part, and an engine for thrusting the watercraft forwardly. The hull is formed in the forward and rearward portions of its lower part with water accommodation compartments formed with a plurality of openings for water to flow therethrough into and out of the compartments. When the watercraft is at rest, water flows into the water accommodation compartments through the openings to stabilize the hull. When the watercraft is cruising, the water in the water accommodation compartments is released therefrom through the openings, so that the watercraft lightly cruises.

6 Claims, 7 Drawing Figures

SMALL WATERCRAFT

BACKGROUND OF THE INVENTION

This invention relates to small watercraft, and more particularly it is concerned with a small watercraft for a crew of one or two at most which is suitable for use to enjoy oneself at one's leisure.

In the small watercraft of the type described, there has been a demand to reduce the width of the hull for increasing the speed and maneuverability of the waterborne vehicle to suit the condition of its use while providing the bottom area necessary for obtaining a hydrodynamic lift to support the weight of the craft and crew when the craft is planing. When the width of the hull of a watercraft is reduced, there arises the problem that the watercraft lacks stability, particularly transversely thereof, when it is at rest and difficulties are encountered in getting aboard the watercraft without the danger of capsizing it.

SUMMARY OF THE INVENTION

This invention has as its object the provision of a small watercraft which has stability, particulary transversely thereof, when at rest even if the width of the hull is reduced to increase the speed and maneuverability of the watercraft.

According to the invention, the watercraft has at least one water accommodation compartment formed with at least one opening in the lower part of its hull so that when the watercraft is at rest, water flows into the water accommodation compartment through the opening and the volume of the hull immersed in the water increases. As a result, the watercraft has increased stability and the crew can get aboard the watercraft with ease. When the watercraft is cruising, the water in the compartment flows out through the opening, so that the watercraft lightly cruises.

DESCRIPTION OF THE PREFERRED EMBODIMENT

Figure 1:
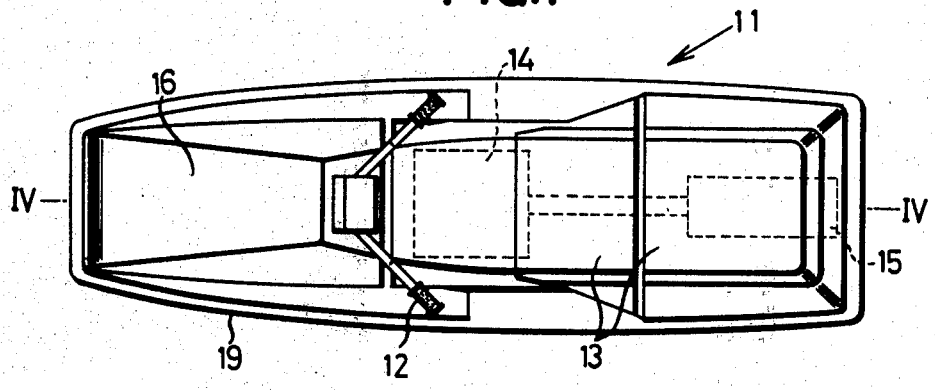
FIG. 1 is a plan view of the small water craft comprising one embodiment of the invention.
Figure 2:
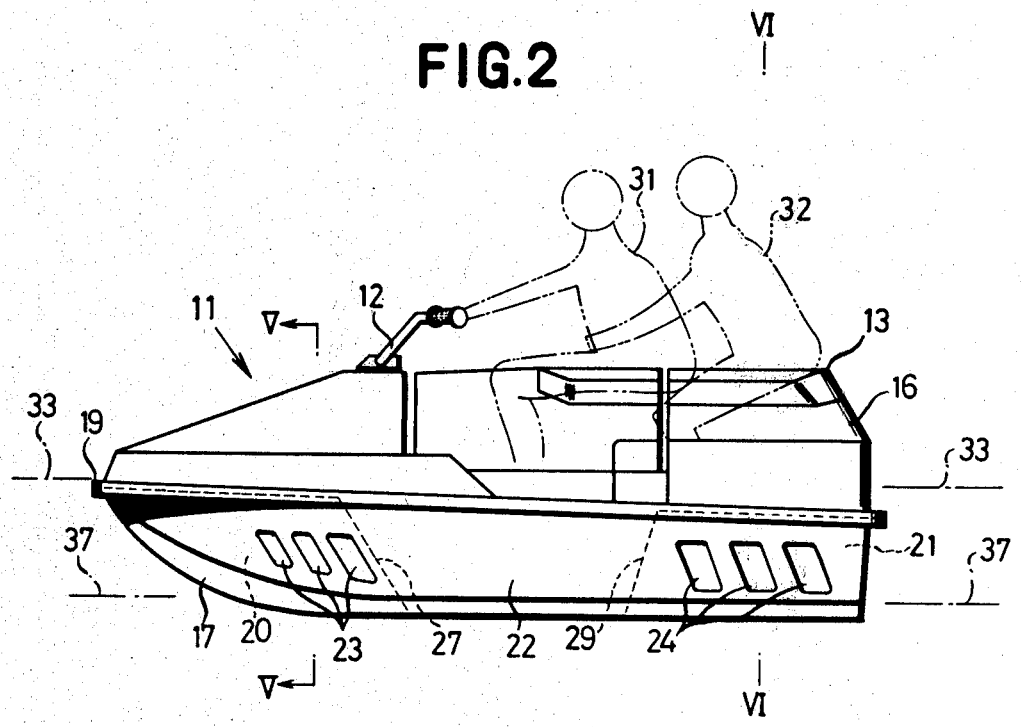
FIG. 2 is a side view of the small watercraft shown in FIG. 1.
Figure 3:
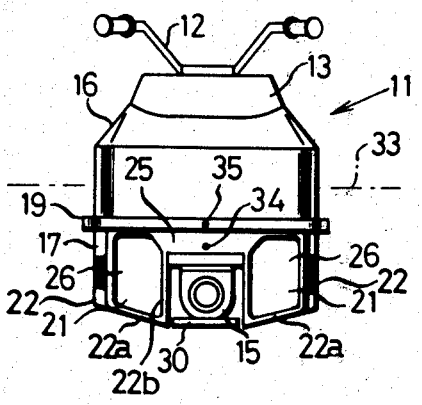
FIG. 3 is a rear view of the small watercraft shown in FIG. 1.
Figure 4:
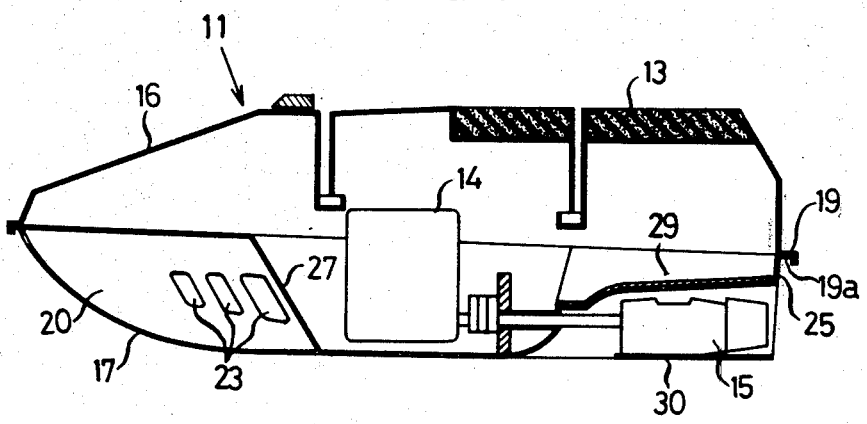
FIG. 4 is a sectional view taken along the line IV—IV in FIG. 1.

The drawings illustrate a preferred embodiment of the small watercraft for a crew of 2. In FIGS. 1-3, a hull 11 is of longitudinally elongated shape for increasing the speed and maneuverability of the watercraft by reducing the resistance offered by water when it cruises. The hull 11 includes a lower part 17 and a deck 16 located over the lower part 17. In the illustrated embodiment, the deck 16 and lower part 17 are formed of fiber glass reinforced plastics (FRP) as separate entities and bonded together at flanges 19 and **19*a* into a unitary structure as shown in FIGS. 2 and 4. A handle 12 is located slightly toward the bow as seen from the central portion of the deck 16, and a seat 13 for two is located at the stern. An engine 14 and a jet propulsion device 15 are housed in the interior of the hull 11**.

Figure 5:
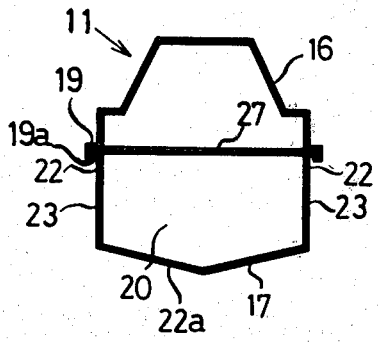
FIG. 5 is a sectional view taken along the line V—V in FIG. 2.
Figure 6:
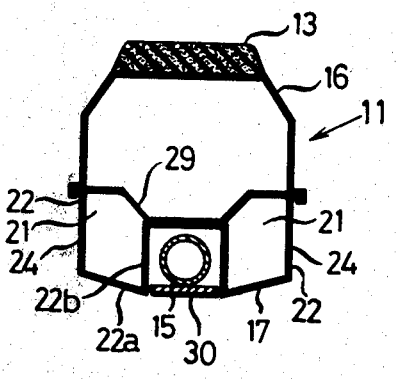
FIG. 6 is a sectional view taken along the line VI—VI in FIG. 2.

As clearly shown in FIGS. 3, 5 and 6, the lower part 17 of the hull 11 is composed of two side plates 22, a bottom plate **22*a* connecting the lower ends of the two side plates 22, and a rear wall 25 located at the rear of the hull 11. As shown in FIGS. 2, 4 and 5, a first partition wall 27 extends from the bow and is bent downwardly substantially midway to define between the first partition wall 27, two side plates 22 and the bottom plate 22*a* a first water accommodation compartment 20 which is disposed in the forward portion of hull 11. The first water accommodation compartment 20 is formed with a plurality of first openings 23 in the opposite side plates 22 so that water can be introduced into the compartment 20 through the openings 23**.

Referring to FIGS. 3 and 6, a cover plate **22*b* for defining a space for housing the jet propulsion device 15 is secured to the bottom plate 22*a* at the rear of the lower part 17 of the hull 11. A second partition wall 29 is secured to the inner sides of the rearward portion of the lower part 17 and bent downwardly in its forward portion as shown in FIGS. 2 and 6, so that two second water accommodation compartments 21 are defined by the second partition wall 29, two side plates 22 of the lower part 17, bottom plate 22*a* of the lower part 17 and cover plate 22*b* and located symmetrically on opposite sides of the jet propulsion device 15**.

The portions of the two side plates 22 defining the second water accommodation compartments 21 in the rearward portion of the hull 11 are each formed with a suitable number of second openings 24. The rear wall 25 of the lower part 17 of the hull 11 is formed with openings 26 for communicating the second water accommodation compartments 21 with the outside. Alternatively, the openings 24 or 26 may be formed only in the two side plates 22 or rear wall plate 25. The numeral 30 in FIGS. 3, 4 and 6 designates a bottom plate for the jet propulsion device 15.

The small watercraft of the aforesaid construction operates as follows. When the watercraft is at rest and the hull 11 is stationary on the water, water flows into the first and second water accommodation compartments 20 and 21 through the first and second openings 23 and 24 and the openings 26 respectively, so that the hull 11 sinks and its waterline moves upwardly as indicated at 33 as shown in FIGS. 2 and 3, and the center of gravity 34 is located lower than the center of buoyancy 35 as shown in FIG. 3. Thus the hull 11 has increased self-rightening ability and stability. When the hull 11 is in this state, the crew 31 and 32 can readily get aboard the watercraft as shown in FIG. 2. After the watercraft has started, the hull 11 floats because the dynamic pressure of the water acts on the bottom surface of the hull. Thus the watercraft is brought to a cruising position, so that the waterline is located at 37 as shown in FIG. 2 and the water in the first and second water accommodation compartments 20 and 21 flows out through the respective openings 23, 24 and 26. Thus the maneuverability of the watercraft is increased, and the watercraft lightly cruises. While the watercraft is in the cruising position, the dynamic pressure of the water acts on the hull 11 so that the hull 11 has high stability, particularly transversely thereof.

Figure 7:
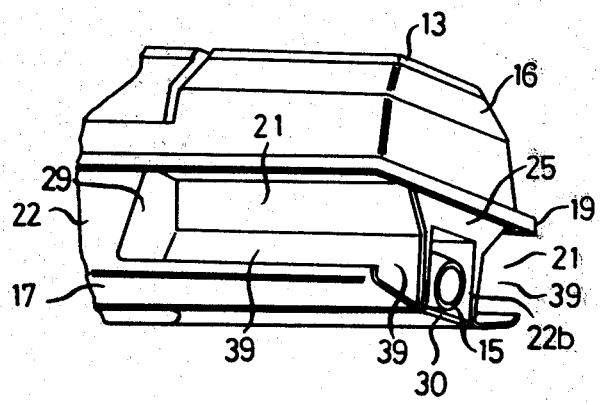
FIG. 7 is a perspective view of a modification of the water accommodation chamber in the rear portion of the hull.

FIG. 7 shows a modification of the second water accommodation compartments 21 in the rearward portion of the hull 11. As shown, each second water accommodation compartment 21 is formed with an opening 39 extending from each side wall 22 of the lower part 17 of the hull 11 to the rear wall 25. This modification allows the openings 39 to be formed with ease by trimming after the lower part 17 of the hull 11 is formed. The modification shown in FIG. 7 is similar in other parts to the embodiment shown in FIGS. 1–6 except for the aforesaid openings 39.

The present invention is not limited to the specific constructional forms of the embodiment and its modification shown and described hereinabove, and many changes and modifications may be made therein without departing from the scope of the invention. Also, various components of the watercraft may be arranged in any other suitable combination as desired. For example, the water accommodation compartments may be provided only in the forward portion or rearward portion alone of the hull. In the embodiment shown and described, the two rear water accommodation compartments have the jet propulsion device interposed therebetween. However, the jet propulsion device may be located in some other position and only one, instead of two, water accommodation compartment may be formed in the rearward portion of the hull. The openings formed in each of the water accommodation compartments may be of any number as desired including 1.

From the foregoing description, it will be appreciated that the small watercraft according to the invention has increased stability, particularly transversely of the hull. Thus even if the hull has a longitudinally elongated shape and a small width for increasing the speed and maneuverability, the crew can get aboard the watercraft with ease when the watercraft is at rest, thereby greatly increasing the practical value of the watercraft.

What is claimed is:

1. A watercraft for planing on water comprising:

a hull of longitudinally elongated shape and reduced width;

propulsion means mounted in said hull;

a bottom surface of said hull for planing by means of said propulsion means; and at least one water accommodation compartment formed in a forward section of said hull above said bottom surface;

said water accommodation compartment formed with a closed front end and a plurality of openings on lateral sides of a lower part of said hull for permitting water to flow into the water accommodation compartment when the watercraft is at rest and out of the water accommodation compartment when the watercraft moves to a cruising position;

said water accommodation compartment additionally formed with at least one partition wall secured to the lower part of the hull.

2. The watercraft of claim 1 in which said partition wall extends obliquely downwardly away from the forward section of said hull.

3. The watercraft of claim 1 additionally comprising two water accommodation compartments formed around the propulsion means in an aft section of said hull.

4. The watercraft of claim 3 in which said two additional water accommodation compartments each comprise at least one opening positioned on at least one of a lateral side and a rear side of the lower part of said hull.

5. The watercraft of claim 4, in which the opening in each additional water accommodation compartment in the aft section of the hull is formed as a continuously extending opening along one lateral side of the lower part of the hull to the rear side of the lower part of the hull.

6. The watercraft of claims 5 or 4 in which said two additional water accommodation compartments each additionally comprise a partition wall extending obliquely downwardly away from the aft section of the hull.

* * * * *